United States Patent [19]

Trozzi

[11] Patent Number: 4,570,549

[45] Date of Patent: Feb. 18, 1986

[54] SPLITTER FOR USE WITH A COAL-FIRED FURNACE UTILIZING A LOW LOAD BURNER

[76] Inventor: Norman K. Trozzi, 57 Annin Rd., W. Caldwell, N.J. 07006

[21] Appl. No.: 611,241

[22] Filed: May 17, 1984

[51] Int. Cl.[4] ..... F23K 1/00

[52] U.S. Cl. ..... 110/106; 110/163; 110/232; 110/263

[58] Field of Search ..... 110/232, 261, 262, 263, 110/264, 265, 267, 106, 163

[56] References Cited

U.S. PATENT DOCUMENTS

| | | | |
|---|---|---|---|
| 2,506,273 | 5/1950 | Linderoth . | |
| 2,684,647 | 7/1954 | Bither | 110/163 |
| 3,580,238 | 5/1971 | Diehl | 110/163 |
| 4,274,343 | 6/1981 | Kokkinos | 110/106 |
| 4,412,496 | 11/1983 | Trozzi | 110/106 |
| 4,425,855 | 1/1984 | Chadshap | 110/106 |
| 4,471,703 | 9/1984 | Vatsky et al. | 110/106 |
| 4,478,157 | 10/1984 | Musto | 110/106 |

*Primary Examiner*—Albert J. Makay
*Assistant Examiner*—Steven E. Warner
*Attorney, Agent, or Firm*—Marvin A. Naigur; John E. Wilson; Warren B. Kice

[57] ABSTRACT

An improved splitter for use with a coal-fired furnace utilizing a low load burner in which a splitter is provided in the main conduit leading from the pulverizer for splitting the stream of coal and air into two separate streams which are then fed to separate nozzles communicating with the furnace. The splitter includes a damper assembly defining a gap which can be adjustable and including a plurality of projections which prevent coal slippage along the damper blade.

9 Claims, 5 Drawing Figures

SPLITTER FOR USE WITH A COAL-FIRED FURNACE UTILIZING A LOW LOAD BURNER

BACKGROUND OF THE INVENTION

This invention relates to a coal-fired furnace utilizing a low load burner and, more particularly, to a splitter for selectively distributing coal and air to the burners associated with said furnace.

In a typical coal-fired furnace, particulate coal is delivered in suspension with the primary air from a pulverizer, or mill, to the burners, and secondary air is provided to supply a sufficient amount of air to support combustion. After initial ignition, the coal is thus caused to burn due to local recirculation of the gases and flame from the combustion process which provides ignition energy to maintain the burning of the coal aided by the radiation from the flame in the furnace and from the furnace walls and conduction from the flame in the furnace.

In these types of arrangements, the coal readily burns after the furnace has been operating over a fairly long period of time. However, for providing ignition flame during startup and for warming up the furnace walls, the convection surfaces and the air preheater, the mixture of primary air and coal from conventional main burners is usually too lean and is not conducive to burning under these relatively cold circumstances. Therefore, it has been the common practice to provide oil or gas fired ignitors and/or guns for warming up the furnace walls, convection surfaces and the air preheater, since these fuels have the advantages of a greater ease of ignition and, therfore require less heat to initiate combustion. The ignitors are usually started by an electrical sparking device or swab and the guns are usually lit by an ignitor or by a high energy or high tension electrical device.

Another application of auxiliary fuels to a coal-fired furnace is during reduced load conditions when the coal supply, and therefore the stability of the coal flame, is decreased. Under these conditions, the oil or gas ignitors and/or guns are used to maintain flame stability in the furnace and thus avoid accumulation of unburned coal dust in the furnace.

However, in recent times, the foregoing advantages of oil or gas-fired warmup and low load guns have been negated by the skyrocketing costs and decreasing availability of these fuels. This situation is compounded by the ever-increasing change in operation of coal-fired burners from the traditional base loaded mode to that of cycling, or shifting, modes which place even more heavy demands on supplemental oil and gas systems to support these types of units.

These problems were largely solved in the arrangement disclosed in applicant's U.S. Pat. No. 4,412,496, also assigned to the assignee of the present invention. In this arrangement a splitter is provided in the main conduit leading from the pulverizer which includes a movable damper for splitting the stream of coal and air into two separate streams. One stream from the splitter is connected to a separator in which a quantity of air is separated from the mixture of air and coal. A low load burner assembly is provided which includes a first nozzle connected to the separator for discharging the bulk of the coal flow and some air into the furnace, and a second nozzle connected to the same separator for discharging the bulk of the air from the separator into the furnace. The other stream from the splitter is connected to a third nozzle which discharges its mixture of air and coal into the furnace to provide high load capability.

However, it was found that control of both the coal and air with a single damper was not as effective as was anticipated. That is, the diversion of the solids along the upper wall of the splitter housing by the damper was not complete enough under all conditions of operation. Also some solids would slide along the damper blade in a downward fashion and slip into a gap formed between the damper and the housing thereby causing an unbalance to the desired flow mixture of solids and air to each of the downstream conduits. Also the damper blade was prone to excessive erosion due to its constant exposure to the abrasive coal particles.

SUMMARY OF THE PRESENT INVENTION

It is therefore an object of the present invention to provide an improved splitter for use with a coal-fired furnace utilizing a low load burner.

It is a further object of the present invention to provide a splitter of the above type in which improved control of the amount of coal and air routed to the furnace burners is achieved.

It is a further object of the present invention to provide a splitter of the above type in which slippage of the coal particles along the damper blade is virtually eliminated.

It is a further object of the present invention to provide a splitter of the above type in which the damper blade is protected against abrasion.

Toward the fulfillment of these and other objects, the splitter of the present invention is adapted to selectively route a mixture of coal and air from an external source to a coal fired furnace, and includes a housing for receiving the mixture and a damper assembly disposed in the housing for splitting the mixture into the two streams. The damper assembly is movable in the housing to control the quantity of mixture in each of said streams and is spaced from a corresponding wall of the housing to define a fixed gap for the passage of a portion of the mixture. The damper assembly including means for varying the size of said fixed gap, for protecting the damper blade and for preventing the slippage of coal particles along the blade.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention, when taken in conjunction with the accompanying drawings wherein.

DESCRIPTION OF THE PREFERRED EMBODIMENTS

Figure 1:
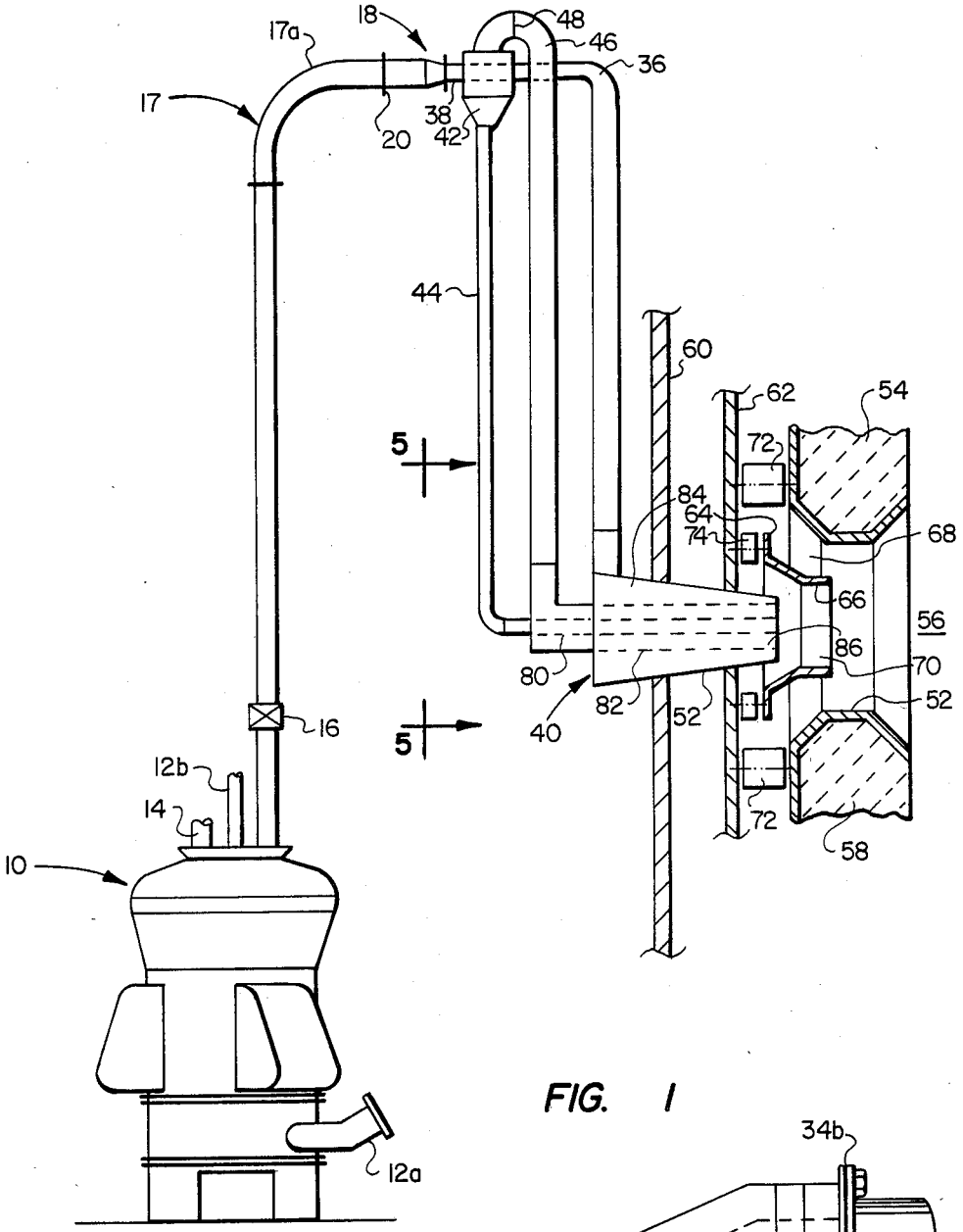
FIG. 1 is a schematic diagram depicting the combustion system of the present invention.

Referring specifically to FIG. 1 of the drawings, the reference numeral 10 refers in general to a mill, or pulverizer, which has an inlet 12*a* for receiving air flow and an inlet 12*b* for receiving raw coal flow both of which are introduced into the mill under the control of a load control system, not shown. The pulverizer 10 operates in a conventional manner to dry and grind the coal into relatively fine particles and has an outlet located in its upper portion which is connected to one end of a conduit 14 for receiving the mixture of pulverized coal and air. A shutoff valve 16 is provided in the conduit 14 and controls the flow of the coal/air mixture to an elbow 17 connected to the other end of the conduit and to a splitter 18 connected to the elbow. The elbow 17 has a rectangular cross-section and the coal is caused to move towards the outer portion 17*a* of the turn of the elbow by centrifugal forces. Therefore, as the stream enters the splitter 18 the coal is essentially concentrated and spread out on the outer surface of the turn of elbow portion 17*a*. It is understood that although only one conduit 14 is shown in detail in the interest of clarity, the mill 10 will have several outlets which connect to several conduits identical to conduit 14 which, in turn, are connected to several elbows 17 and splitters 18, with the number of outlets, conduits, elbows and splitters corresponding in number to number of burners utilized in the particular furnace.

Figure 2:
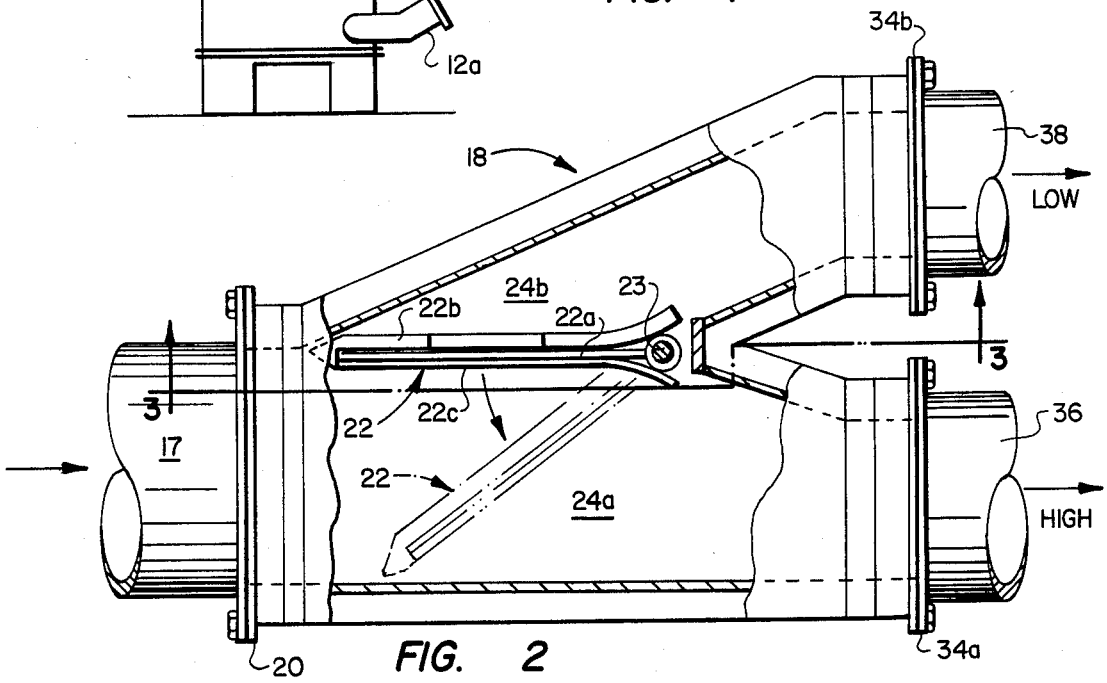
FIG. 2 is a plan view of the splitter utilized in the system of FIG. 1.
Figure 3:
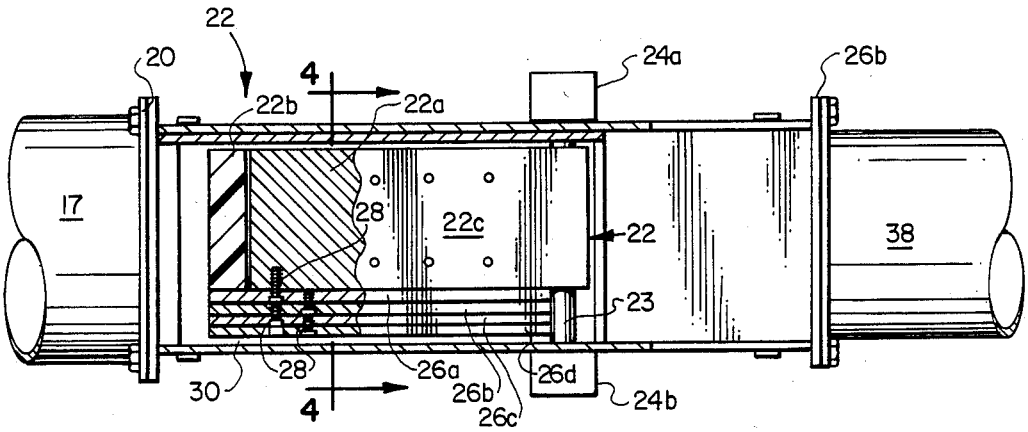
FIG. 3 is a cross-sectional view taken along the line 3—3 of FIG. 2.
Figure 4:
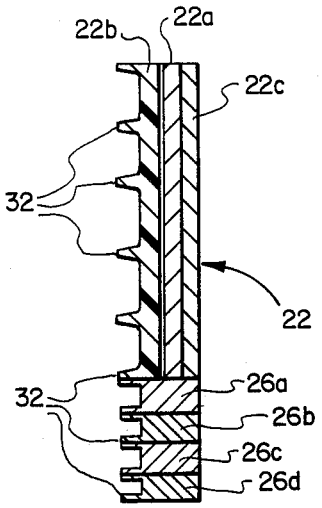
FIG. 4 is a cross-sectional view taken along the line 4—4 of FIG. 3.

The splitter 18 is shown in detail in FIGS. 2–4 and includes a connecting flange 20 which connects to the end portion of the elbow 17. A damper assembly 22 is provided in the interior of the splitter 18 and divides the latter into a chamber 24*a* extending in line with the end portion of the elbow 17, and a chamber 24*b* extending immediately adjacent the chamber.

The damper assembly 22 is formed by a center blade 22*a* sandwiched between a ceramic plate 22*b* and a carbon steel plate 22*c*. The blade 22*a* is attached at one end to a rotatable shaft 23 which is journaled at each end in actuator housings 24*a* and 24*b* and is under the control of a actuator system (not shown) which controls the pivotal movement of the shaft and therefore the position of the damper assembly 22. The plates 22*b* and 22*c* are secured to the blade 22*c* in any conventional manner and function to protect the latter blade from the abrasion of the coal particles, as will be explained.

As shown in FIGS. 3 and 4, a plurality of bars 26*a*, 26*b*, 26*c* and 26*d* are quick-detachably fastened, by means of bolts 28, along the lower edge portion of the damper assembly 22. More particularly, the bar 26*a* is fastened by a bolt 28 to the lower edge of the blade 22*a*, the bar 26*b* is fastened by a bolt 28 to the lower edge of the bar 26*a*, the bar 26*c* is fastened by a bolt 28 to the lower edge of the bar 26*b*, and the bar 26*d* is fastened to the lower edge of the bar 26*c*. A gap 30 is defined between the lower edge of the bar 26*d* and the lower wall of the splitter housing, as shown in FIG. 3. One or more the of bars 26*a*–26*d* can be fastened to or removed from the damper assembly 22 to vary the vertical height of the gap 30, for reasons that will be explained.

As shown in FIG. 4, a plurality of projections 32 are provided on the exposed faces of the plate 22*b* and the bars 26*a*–26*d* for the purpose of reducing the amount of coal slippage along the latter faces.

When the damper assembly 22 is in the position shown by the solid lines in FIG. 2, most of the flow from the elbow 17 will be directed into the chamber 24*a* and when the assembly is in the position as shown by the dashed lines, most of the flow will be diverted into the chamber 24*b*. Depending on the distance of the free end of the damper assembly 22 to the side walls of the splitter 18, the quantity of flow to each of the chambers 24*a* and 24*b* can be controlled as required by the control system operating the shaft 23.

Also, the gap 30 permits some flow into the chamber 24*b* when the damper assembly 22 is in the solid-line position and some flow into the chamber 24*a* when the damper is in the dashed line position. The amount of flow depends on the size of the gap 30 which is determined by the number of bars 26*a*–26*d* attached to the lower edge of the damper assembly 22.

The combined effect of the rotation of the damper assembly 22 and the presence of the gap 30 results in a division of the total air and coal flow into each of the chambers 24*a* and 24*b* at all loads in a proportion that produces the desired operational characteristics that will be described in detail later.

As shown in FIG. 2, two connecting flanges 34*a* and 34*b* connect the chambers 24*a* and 24*b* to two conduits 36 and 38, respectively. As shown in FIG. 1, the conduit 36 extends from the splitter to a burner nozzle assembly, shown in general by the reference numeral 40, and the conduit 38 is connected directly from the splitter to a cyclone separator 42. The cyclone separator 42 thus receives the mixture of pulverized coal and air from the conduit 38 and operates in a conventional manner to separate a large portion of air from the mixture. The separated coal, which contains relatively little air (in the order of 1%) is discharged into a low load conduit 44 and the air is discharged into a vent air conduit 46. The conduits 44 and 46 are connected to the burner nozzle assembly 40 in a manner to be described in detail later and a vent damper 48 is provided in the conduit 46 for controlling the flow of air between conduits 44 and 46.

The burner nozzle assembly 40 is disposed in axial alignment with a through opening 52 formed in a front wall 54 of a conventional furnace forming, for example, a portion of a steam generator. It is understood that the furnace includes a back wall and a side wall of an appropriate configuration to define a combustion chamber 56 immediately adjacent the opening 52. The front wall 54, as well as the other walls of the furnace include an appropriate thermal insulation material 58 and, while not specifically shown, it is understood that the combustion chamber 56 can also be lined with boiler tubes through which a heat exchange fluid, such as water, is circulated in a conventional manner for the purposes of producing steam.

A vertical wall 60 is disposed in a parallel relationship with the furnace wall 54, and has an opening formed therein for receiving the burner nozzle assembly 40. It is understood that top, bottom, and side walls (not shown) are also provided which, together with the wall 60, form a plenum chamber or wind box, for receiving combustion supporting air, commonly referred to as "secondary air", in a conventional manner.

An annular plate 62 extends around the burner 40 and between the front wall 54 and the wall 60. An additional annular plate 64 is provided between the plate 62 and the furnace wall 54 and extends in a spaced, parallel relation with the plate 62. An air divider sleeve 66 extends from the inner surface of the plate 64 and between the opening 52 and the burner 40 to define two air flow passages 68 and 70.

A plurality of outer register vanes 72 are pivotally mounted between the front wall 54 and the plate 62, to control the swirl of the secondary air from the wind box to the air flow passages 68 and 70. In a similar manner a plurality of inner register vanes 74 are pivotally mounted between the plates 62 and 64 to further regulate the swirl of the secondary air passing through the annular passage 70. It is understood that although only two register vanes 72 and 74 are shown in FIG. 1, several more vanes extend in a circumferentially spaced relation to the vanes shown. Also, the pivotal mounting of the vanes 72 and 74 may be done in any conventional manner, such as by mounting the vanes on shafts (shown schematically) and journaling the shafts in proper bearings formed in the front wall 54 and the plates 62 and 64. Also, the position of the vanes 72 and 74 may be adjustable by means of cranks or the like. Since these types of components are conventional they are not shown in the drawings nor will be described in any further detail.

The burner nozzle assembly 40 includes a nozzle 80 which is connected to the conduit 44, a nozzle 82 which is connected to the conduit 46 and a nozzle 84 which is connected to the conduit 36. The conduit 80 thus receives the dense phase particulate coal from the separator 42 and discharges it towards the opening 52 in the furnace wall 54. The nozzle 82 extends around the nozzle 80 in a coaxial relationship and thus defines an annular air passage, which receives the air from the separator 42 and discharges it in a combustion supporting relation to the dense phase coal discharging from the nozzle 80 in a manner to be described in detail later. The outer nozzle 84 extends around the nozzle 82 in a coaxial relationship therewith and thus defines an annular passage which receives the mixture of air and coal from the splitter 18. The nozzle 84 is conical shaped so that the passage between it and the air nozzle 82 decreases in cross-section as the mixture of air and coal discharges from the nozzle 84.

A plurality of swirl vanes 86 are provided in the annular passage between the nozzle 80 and the nozzle 82 to impart a swirl to the air as it discharges into the opening 52. The vanes 86 can be of a conventional design and, as such, are tapered in a radially inward direction and are mounted in the annular passage between the nozzles 80 and 82 in a manner to permit them to impart a swirl to the air passing through the passage.

Figure 5:
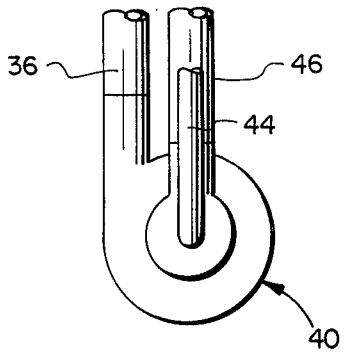
FIG. 5 is a fragmentary rear elevational view taken along the line 5—5 of FIG. 1.

As better shown in FIG. 5, the connection between the conduit 36 and the nozzle 84 is in a tangential direction so that a swirl is imparted to the air/coal mixture as it passes through the annular passage between the nozzles 82 and 84 before discharging towards the opening 52.

Although not shown in the drawings for the convenience of presentation, it is understood that various devices can be provided to produce ignition energy for a short period of time to the dense phase coal particles discharging from the nozzle 80 to ignite the particles. For example, a high energy sparking device in the form of an arc ignitor or a small oil or gas conventional gun ignitor can be supported by the burner nozzle assembly 40.

Assuming the furnace discussed above forms a portion of a vapor generator and it is desired to start up the generator, the pulverizer 10 begins receiving air flow and a small amount of coal flows through its inlets 12 and 12*a*, respectively, and operates to crush the coal into a predetermined fineness. The lean mixture of air and finely pulverized coal is discharged from the pulverizer 10 where it passes into and through the conduit 14 and the valve 16, and through the elbow 17 into the splitter 18. Since, in its passage through the elbow 17 the coal tends to move to the outer surface of the elbow as discussed above, a large portion of the mixture of coal and air entering the lower portion (as viewed in FIGS. 1 and 3) of the splitter 18 is air, while a large portion of the mixture entering the upper portion of the splitter is coal. As a result, and with the damper assembly 22 in the position shown by the dashed lines in FIG. 2, the bulk of the coal plus a portion of the air is directed into the chamber 24*b* and into the conduit 38. Since the balance of the coal remaining in the splitter 18 is in the upper portion thereof, and the air in the lower portion, a relatively high quantity of air and a relatively low quantity of coal passes underneath the damper assembly 22, through the gap 30 and into the chamber 24*a* by the static pressure caused by the resistance imposed by the sizing of the separator 42 and the components downstream of the separator. The air and coal carried into the chamber 24*a* in this manner will flow into and through the conduit 36 and to the nozzle 84.

The coal-air mixture passing through the chamber 24*b* which, in accordance with the foregoing, is most of the coal being pulverized at startup, passes into and through the conduit 38 and into the separator 42 where it is separated into dense phase particulate coal and air which are passed through the conduits 44 and 46 to the nozzles 80 and 82, respectively. The dense phase particulate coal from the nozzle 80 in combination with the vented primary air from the nozzle 82 is caused to intermix and recirculate in front of nozzles 80 and 82 as a result of the spin imparted to the air by the vanes 86 and the resulting reverse flow effect of the vortex formed. The result is a rich mixture which can readily be ignited by one of the techniques previously described, such as, for example, directly from a high energy spark, or an oil or gas ignitor. Although the pulverizer coal output is low, the concentration of the fuel stream results in a rich mixture which is desirable and necessary at the point of ignition. The vortex so formed by this arrangement produces the desired recirculation of the products of combustion from the fuel being burned to provide the heat to ignite the new fuel as it enters the ignition zone.

The load on the unit can then be increased by placing more burners into service on the same pulverizer or by placing more pulverizers into service in a similar fashion. When the desired number of pulverizers and burners are in service and it is desired to further increase the load, the coal flow is increased to each pulverizer. At the same time, the damper assembly 22 associated with each pulverizer 10 is rotated towards its respective chamber 24*b* to cause some of the particulate coal which has concentrated in the upper portion of the splitter 18, along with a quantity of primary air, to be directed into the chamber 24*a* for passage, via the conduit 36 to the nozzle 84.

As the coal rate increases to full capacity, the damper assembly 22 continues to be rotated towards the chamber 24*b* until it reaches the position shown approximately by the solid lines in FIG. 2.

In this position, a maximum flow of the coal/air mixture into the chamber 24*a* is achieved while some of the mixture passes through the gap 30, past the damper assembly 22, through the chamber 24*b*, the conduit 38, and into the separator 42. By characterizing the motion of the damper assembly 22 with the mill output loading, the amount of coal and combustion supporting air going to the separator 42 and therefore to the low load nozzles 80 and 82 can be kept at a low heat input value (approximately 5 to 20 percent of full load) while the main nozzle 84 will increase (or decrease) in loading as required. Sufficient turbulence is maintained by the low load burners 80 and 82, although as load is increased the effect of the main registers and secondary air flow patterns will further aid in overall burner stability.

It is understood that the above arrangement may or may not require some preheated air depending on the moisture content of the fuel. If necessary, this heat can be provided by any of the conventional duct air heating techniques to increase the temperature of the primary air entering the pulverizer 10.

Also, it is understood that the present invention is not limited to the specific burner and nozzle arrangement disclosed above but can be adapted to other configurations as long as the foregoing results are achieved. Also, various types of separators, other than the cyclone separator discussed above, can be used within the scope of the invention.

Several advantages result from the foregoing. For example, the energy expenditures from the ignitor occurs only for the very short time needed to directly ignite the dense phase particulate coal from the nozzle 80, after which startup and warmup are completed solely by the combustion of the dense phase particulate coal as assisted by the swirling air from the nozzle 82. Also, the dense phase particulate coal low load nozzle 80 stabilizes the main coal flame at wide load range conditions providing more flexibility of operation and less manipulation of auxiliary fuels. Further the adjustable gap 30 provides a means to obtain the proper air flow in each of the conduits 36 and 38 while relieving the excess primary air flow into the conduit 36 which is not needed for combustion through conduit 38 but needed for the pulverizer and its conduits. Also, at high load the adjustable gap 30 permits a controlled amount of air and coal to flow into the low load system to maintain the burner flame. Still further, the projections 32 on the plate **22*b* of the damper assembly 22 and on the bars 26*a*–26*d* prevent coal slippage down the face of the plate and into the gap 30 when the assembly is in the position shown by the dashed lines in FIG. 2. Still further, the use of the ceramic plate 22*b* and the carbon steel plate extending along both faces of the damper blade 22*a*** protect the latter from abrasion.

It is understood that the system and method described herein can be adapted to most existing systems and any new installation since the flow is divided in various parallel paths and additional pressure losses are kept to a minimum.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A splitter for directing a mixture of coal and air from an external source to a coal fired furnace, said splitter comprising a housing for receiving said mixture; an elongated damper blade assembly disposed in said housing for dividing said mixture into two streams, said damper blade assembly being pivotable at one end portion for movement in said housing to control the quantity of mixture in each of said streams, a longitudinal edge portion of said damper blade assembly being spaced from a corresponding wall of said housing in all positions of said blade assembly to define a fixed gap for the passage of a portion of said mixture; a plurality of bars; and means quick detachably connecting said bars to said damper assembly for varying the size of said fixed gap.

2. A splitter for directing a mixture of coal and air from an external source to a coal fired furnace, said splitter comprising a housing for receiving said mixture; and a damper assembly disposed in said housing for dividing said mixture into two streams, said damper assembly being movable in said housing to control the quantity of mixture in each of said streams, said damper assembly comprising a damper blade defining two opposed face portions, a ceramic plate and a steel plate extending over said opposed face portions, respectively, and a plurality of projections extending from said ceramic plate for preventing coal movement along said ceramic plate.

3. A splitter for directing a mixture of coal and air from an external source to a coal fired furnace, said splitter comprising a housing for receiving said mixture; an elongated damper blade assembly disposed in said housing for dividing said mixture into two streams; said damper blade assembly comprising a damper blade defining two opposed face portions, and a pair of plates extending over said opposed face portions, respectively, said damper blade assembly being pivotable at one end portion for movement in said housing to control the quantity of mixture in each of said streams, a longitudinal edge portion of said damper blade assembly being spaced from a corresponding wall of said housing in all positions of said blade assembly to define a fixed gap for the passage of a portion of said mixture; and means quick detachably connected to said damper blade assembly for varying the size of said fixed gap.

4. The splitter of claim 3 further comprising a plurality of projections extending from one of said face portions for preventing coal movement along said latter face portion.

5. The splitter of claim 3 wherein one of said plates is ceramic and the other is steel.

6. The splitter of claim 5 further comprising a plurality of projections extending from said ceramic plate for preventing coal movement along said latter plate.

7. A splitter for directing a mixture of coal and air from an external source to a coal fired furnace, said splitter comprising a housing for receiving said mixture and a damper disposed in said housing for dividing said mixture into two streams, said damper comprising a blade defining two opposed face portions, a pair of plates extending over said opposed face portions, respectively, said damper being movable in said housing to control the quantity of mixture in each of said streams, and a plurality of projections extending from one of said plates for preventing coal movement along said latter plate.

8. The splitter of claim 7 wherein one of said plates is ceramic and the other is steel.

9. The splitter of claim 8 wherein said projections extend from said ceramic plate.

* * * * *